US005279121A

United States Patent [19]

Barber

[11] Patent Number: 5,279,121

[45] Date of Patent: Jan. 18, 1994

[54] FLOW CONTROL VALVE WITH PILOT OPERATION AND PRESSURE COMPENSATION

[75] Inventor: Dennis R. Barber, Chanhassen, Minn.

[73] Assignee: Eaton Corporation, Cleveland, Ohio

[21] Appl. No.: 6,426

[22] Filed: Jan. 19, 1993

[51] Int. Cl.[5] ..... F15B 9/04; F15B 13/042

[52] U.S. Cl. ..... 60/422; 60/427; 60/452; 91/512; 137/596; 137/596.13; 137/625.6; 137/625.63

[58] Field of Search ..... 60/422, 427, 452; 91/512; 137/596, 596.13, 625.6, 625.63

[56] References Cited

U.S. PATENT DOCUMENTS 2,526,709 10/1950 Tait .
2,600,348 6/1952 Walthers .
3,602,243 8/1971 Holt .
3,893,471 7/1975 Byers .
4,126,293 11/1978 Zeuner .
4,201,116 5/1980 Martin .
4,220,174 9/1980 Spitz .
4,693,272 9/1987 Wilke .

*Primary Examiner*—Gerald A. Michalsky

*Attorney, Agent, or Firm*—L. J. Kasper

[57] ABSTRACT

A pilot-actuated, pressure-compensated flow and directional control valve assembly (11) is provided in which a main valve spool (95) is positioned in response to a pressure differential between a pilot chamber (119) and a reaction chamber (117). Flow of fluid from an inlet port (29) is controlled by means of a pilot valve assembly (97), into the pilot chamber (119), while fluid flows out of the pilot chamber (119) through a fixed orifice (67) to a pump load sense port (61). The main valve spool (95) acts as an inlet compensator. If the pressure at a load L is above inlet pressure, the main valve spool (95) acts as an inlet check, preventing reverse flow. If there is a higher load pressure at another load circuit in the system, such as a steering valve S, there will be an increase in pressure in the reaction chamber (117), thus closing off the main spool (95), reducing the flow from the inlet port (29) to the work port (47), and giving more priority to the steering valve S. If a priority circuit demands more flow at a lower pressure than the pump can provide to both circuits, the main spool (95) closes in an attempt to maintain a margin pressure which insures that the priority circuit gets the flow it needs.

10 Claims, 5 Drawing Sheets

FLOW CONTROL VALVE WITH PILOT OPERATION AND PRESSURE COMPENSATION

BACKGROUND OF THE DISCLOSURE

The present invention relates to directional control valves, and more particularly, to such valves which are both pressure-compensated and pilot-operated.

The present invention is especially suited for use with proportional flow control valves, and will be described in connection therewith. By "proportional", it is meant that changes in the output flow of fluid from the control valve to the motor which is being controlled are generally proportional to changes in the input, which may be a mechanical input movement or an electromagnetic input, etc.

As will be described in greater detail subsequently, the present invention may be utilized advantageously in a four-way, three- or four-position directional and flow control valve, or in a three-way, three-position directional and flow control valve. For simplicity of illustration, the invention will be described in connection with a three-position, three-way valve. In most commercial directional and flow control valves, various added features are considered desirable, or perhaps even necessary, for the valve to be functionally satisfactory, one example of such an added feature would be the provision of inlet check valves, so that a load under high pressure cannot cause a back-flow (or reverse flow) from the load back through the valve and out the inlet port.

Pilot-operated flow control valves of the type to which the present invention relates are known, generally, from U.S. Pat. Nos. 2,526,709 and 2,600,348. In such pilot-operated valves, there is a main valve spool which is capable of controlling both direction and quantity of fluid flow from an inlet port to a work port. The position of the main valve spool is determined by a pilot pressure which results from movement of a pilot spool disposed slidably within the main valve spool. Movement of the pilot spool communicates pilot pressure to the appropriate end of the main valve spool to move the main valve spool to the desired position. In such pilot-operated valves, the relationship of the main valve spool to the pilot spool is simply that of a "follow-up", i.e., subsequent to movement of the pilot spool, the main valve spool follows the pilot spool until the main valve spool is again in a "neutral" position relative to the pilot spool. Typically, the only factor which determines the position of the main valve spool is the position of the pilot spool.

A typical pressure-compensated directional flow control valve is illustrated and described in U.S. Pat. No. 3,602,243, assigned to the assignee of the present invention and incorporated herein by reference. In such valves, there is typically a main valve spool, normally manually actuated, and a separate pressure-compensating valve section, the function of which is to regulate the flow from the inlet to the main valve spool to maintain a constant pressure differential across the main valve spool, regardless of the rate of fluid flow through the main valve spool. The pressure compensating valve typically includes a pressure-compensating spool which is positioned in response to the differential between inlet pressure and the pressure downstream of the main valve spool.

The addition of pressure compensation capability to a typical directional flow control valve adds substantially to the complexity of the valve section, requiring several additional "cores" in the valve housing casting, and a substantial amount of additional machining of the bore in which the pressure compensating spool is disposed. In addition, the pressure compensating spool itself, and any associated biasing springs, etc., represent a further added manufacturing cost.

If a particular directional flow control valve, whether pilot-operated, or pressure-compensated, is to be used in connection with a load sensing system, it is typically necessary to include within the system a load sensing priority flow control valve. The function of such a valve is to direct the appropriate amount of flow to a priority load circuit, while directing the remainder of the flow to an auxiliary load circuit. As is well known to those skilled in the art, typical load sensing priority flow control valves also add substantially to the cost and complexity of a typical hydraulic circuit.

SUMMARY OF THE INVENTION

Accordingly, it is an object of the present invention to provide an improved directional flow control valve assembly which is both pilot-operated and pressure-compensated, but without the need for substantial additional complex and expensive structure.

It is a further object of the present invention to provide such a pilot-operated, pressure-compensated valve assembly which may be utilized in a load-sensing priority system with another load circuit, wherein either the other load circuit or the valve of the present invention may have either pressure or flow priority, or both.

It is a more specific object of the present invention to provide such a pilot-operated, pressure-compensated valve assembly in which no separate pilot pressure source is required, and wherein a greater pilot force is available than would typically be available in systems using a separate pilot pressure source.

The above and other objects of the invention are accomplished by the provision of a flow control valve assembly for controlling the flow of fluid from a source of pressurized fluid to a fluid pressure-operated device, the flow control valve assembly comprising a valve housing defining a valve bore, an inlet port for connection to the source of fluid, a work port for connection to the fluid pressure operated device, and a return port. A main valve spool is disposed within the valve bore and axially movable therein between a neutral position blocking fluid communication from the inlet port to the work port, and an operating position permitting fluid communication from the inlet port to the work port. The main valve spool defines a pilot bore and fluid passage means communicating between the inlet port and the pilot bore. A pilot spool is disposed within the pilot bore and axially movable therein between a neutral position blocking fluid communication through the fluid passage means, and an actuated position permitting fluid communication through the fluid passage means. The valve housing and the main valve spool cooperate to define a pilot pressure chamber in fluid communication with the fluid passage means when the pilot spool is in the actuated position, fluid pressure in the pilot pressure chamber being operable to move the main valve spool from its neutral position toward its operating position.

The improved flow control valve assembly is characterized by the source of pressurized fluid including pressure-responsive means for varying the delivery of fluid in response to changes in a load signal pressure. The valve housing defines a work load signal port for connection to the pressure-responsive means, the work load signal port being in restricted fluid communication with the pilot pressure chamber. A pilot quantity of pressurized fluid enters the inlet port at a pressure P1, flows through the passage means to the pilot pressure chamber at a pressure P2, P2 being less than P1, then flows to the work load signal port at a pressure P3, P3 being less than P2.

DESCRIPTION OF THE PREFERRED EMBODIMENT

Figure 1:
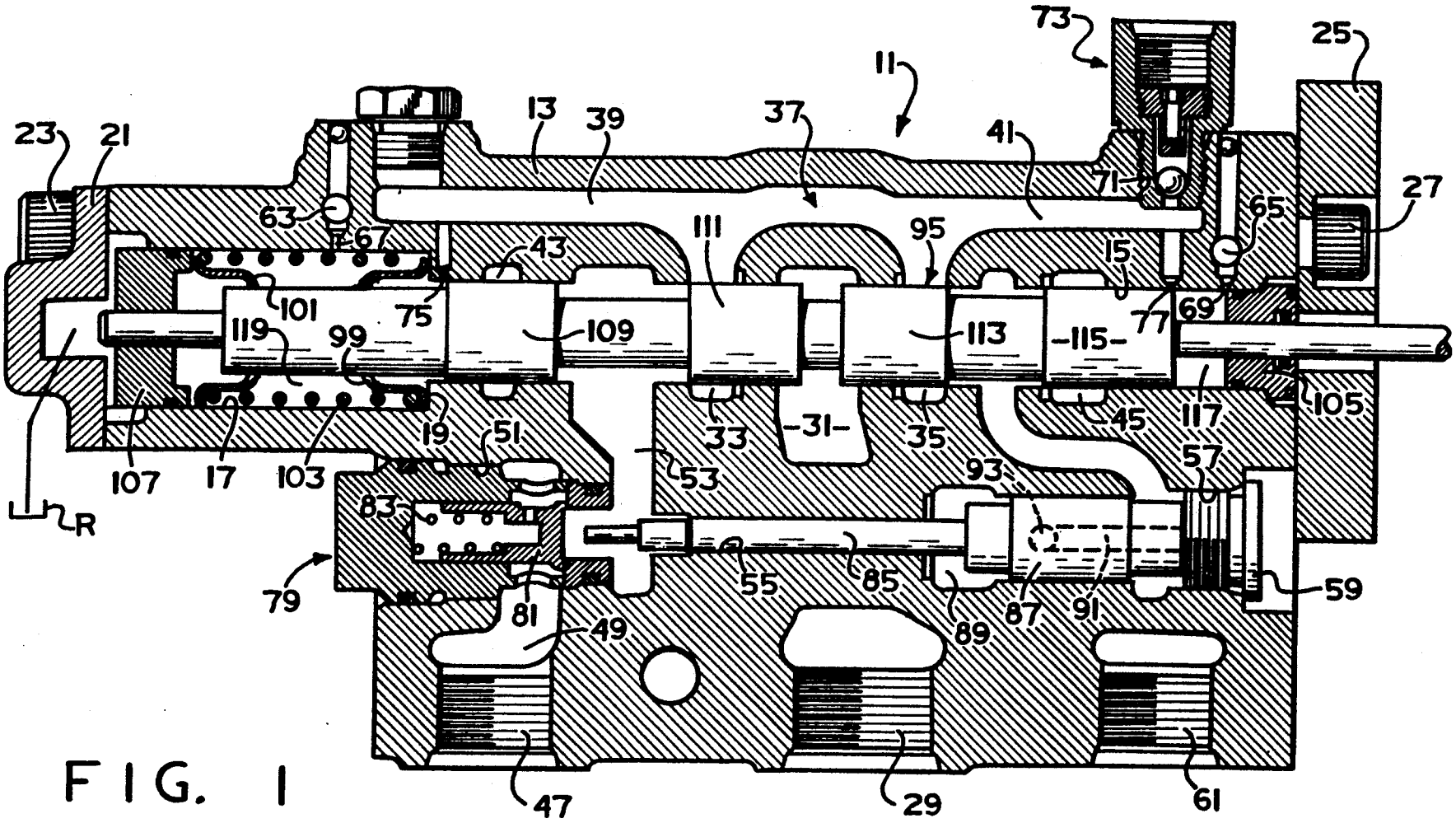
FIG. 1 is an axial cross-section of the directional and flow control valve assembly of the present invention, with the main valve spool shown in external plan view.

Referring now to the drawings, which are not intended to limit the invention, FIG. 1 illustrates a directional and flow control valve assembly made in accordance with the present invention. The flow control valve assembly, generally designated 11, is illustrated, by way of example only, as a three-position, three-way valve. The valve assembly 11 includes a valve body 13, which defines a main valve bore 15. At its left end in FIG. 1, the valve bore 15 includes an enlarged bore portion 17, the intersection of the bore 15 and the bore portion 17 defining an annular shoulder 19. The bore portion 17 is closed by an endcap 21, in tight, sealing engagement with the valve body 13 by means of a plurality of bolts 23, and the valve bore 15 is closed, at its right end in FIG. 1 by an endcap 25, which is in tight sealing engagement with the valve body 13 by means of a plurality of bolts 27.

The valve body 13 defines an inlet port 29, which is in fluid communication with an inlet coring 31 which, in turn, intersects the valve bore 15. Disposed on axially opposite sides of the inlet coring 31 are the left and right legs 33 and 35, respectively, of a generally U-shaped cored portion, generally designated 37, which also includes a leftward portion 39 and a rightward portion 41. The valve body 13 further defines a left tank coring 43 and a right tank coring 45, both of the corings 43 and 45 being in open communication with the valve bore 15. The valve body 13 further defines a workport (cylinder port) 47, which is in open communication with a workport coring 49, the coring 49 being in open communication with a threaded bore 51, the function of which will be described subsequently. At its right end in FIG. 1, the bore 51 is in open communication with a coring 53 which intersects and communicates with the main valve bore 15 between the left leg 33 and the left tank coring 43.

The valve body 13 defines a smaller bore portion 55 and a larger, partially threaded bore portion 57, both of the bores 55 and 57 being coaxial with the bore 51, and the threaded bore 57 being closed by a threaded plug 59.

Referring still to FIG. 1, the valve body 13 defines a pump load sense port 61 which is in fluid communication, in a manner not seen in the plane of FIG. 1, with a transverse pump load sense passage 63, and with a transverse pump load sense passage 65. The passage 63 is in open communication with the enlarged bore portion 17 through a fixed orifice 67, while the passage 65 is in open communication with the valve bore 15 through a fixed orifice 69.

Adjacent the right end of the rightward portion 41, the valve body 13 defines a threaded bore 71, and in threaded engagement therewith is a loadsensing check plug assembly, generally designated 73, the function of which is to communicate a workport load sense pressure from the cored portion 37 out to a signal line (to be illustrated subsequently), while not permitting any flow of fluid from the outside into the rightward portion 41. The leftward portion 39 of the cored portion 37 is in communication with the bore portion 17 through a fixed orifice 75, while the rightward portion 41 of the cored portion 37 is in communication with the valve bore 15 by means of a fixed orifice 77. The fixed orifices 67 and 69, and 75 and 77 relate to an important aspect of the present invention, and will be described in greater detail subsequently.

Disposed in threaded engagement with the bore 51 is a lockout plug assembly, generally designated 79, which includes a poppet member 81 biased to the closed position shown in FIG. 1 by means of compression spring 83. Disposed in the smaller bore portion 55 is a lockout rod 85, and disposed in the larger bore portion 57 is a lockout plunger 87. Adjacent the left end in FIG. 1 of the bore portion 57 is an additional tank coring 89, and it should be understood that all of the tank corings 43, 45, and 89 are in open communication with a return port (not shown herein). The lockout plunger defines an axially-extending passage 91 which is in communication with a radial passage 93, the function of which will be described subsequently.

Figure 2:
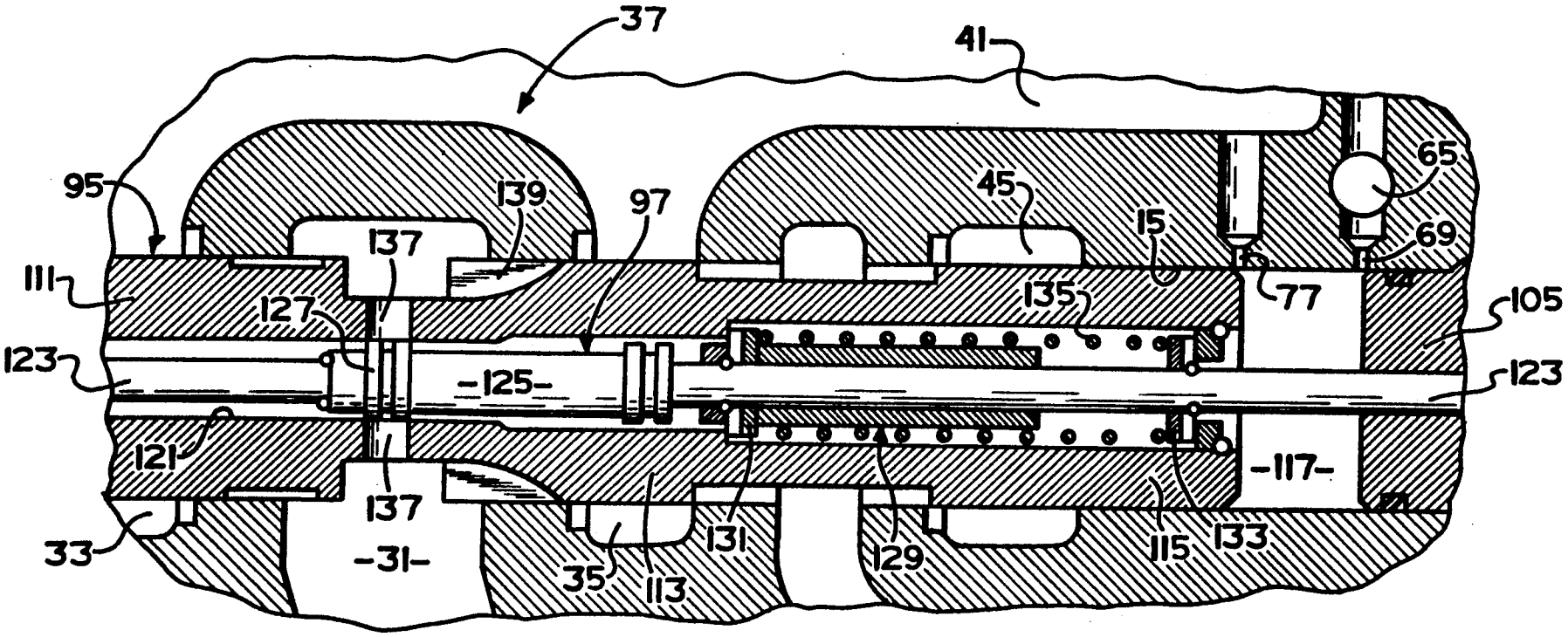
FIG. 2 is a fragmentary, enlarged axial cross-section, similar to FIG. 1, but with the main valve spool in axial cross-section, and with the pilot valve assembly shown in external plan view, and with both valves in their neutral position.

Referring now to FIG. 2, in conjunction with FIG. 1, disposed within the valve bore 15, and also within the bore portion 17 is a valve spool assembly comprising a main valve spool 95 and a pilot valve assembly, generally designated 97. As may best be seen in FIG. 1, adjacent the left end of the main valve spool 95 is a centering spring mechanism comprising right and left spring seats 99 and 101, respectively, between which is disposed a compression spring 103 whereby, subsequent to movement of the main valve spool 95 in either direction from the neutral position shown in FIG. 1, the spring 103 will bias the spool 95 toward the neutral position. Disposed within the valve bore 15 is a guide member 105, and disposed within the bore portion 17 is a guide member 107, the function of the members 105 and 107 to be described subsequently.

Referring still to FIGS. 1 and 2, the main valve spool 95 includes, from left to right in the FIGS., spool lands 109, 111, 113, and 115. The land 115 cooperates with the valve bore 15 to define a reaction pressure chamber 117, while the land 109 cooperates with the bore portion 17 to define a pilot pressure chamber 119, the term "reaction" being used in regard to the chamber 117 in the three-position,/three way embodiment, because the pressure in the chamber 117 exerts a reaction force in opposition to that exerted by the pressure in the pilot pressure chamber 119.

Referring still primarily to FIGS. 1 and 2, the main valve spool 95 defines a pilot bore, which is designated 121, although it should be noted toward the right end of the main spool 95 that the bore 121 has enlarged portions, not bearing separate reference numerals. The pilot valve assembly 97 comprises an elongated rod member 123, the left end of which extends through a cylindrical opening in the guide member 107, while its right end extends through a cylindrical opening in the guide member 105, and then extends axially beyond the endcap 25. The function of the right end portion of the rod member 123 is to be engaged by a suitable actuator (not shown herein) which may comprise a mechanical linkage, or a hydraulic actuator, or an electromagnetic actuator. It should be understood that the particular actuator forms no part of the present invention, although the flow control valve assembly 11 of the present invention imposes somewhat different requirements on the actuator for the pilot valve assembly 97 than is conventional, such additional requirements to be discussed subsequently. It is one advantage of the present invention that it facilitates switching from one form of actuator, such as an electromagnetic actuator, to another form of actuator, such as a mechanical linkage, without any substantial change in, or redesign of, the pilot valve assembly 97.

The pilot valve assembly 97 includes a hollow, cylindrical sleeve 125 having a pair of lands 127 disposed at each end thereof. In the subject embodiment, the sleeve 125 is provided with lands 127 at each end simply to make the sleeve 125 reversible, i.e., it cannot be incorrectly assembled on the rod member 123 as it could be if it had lands at only one end of the sleeve 125.

Figure 3:
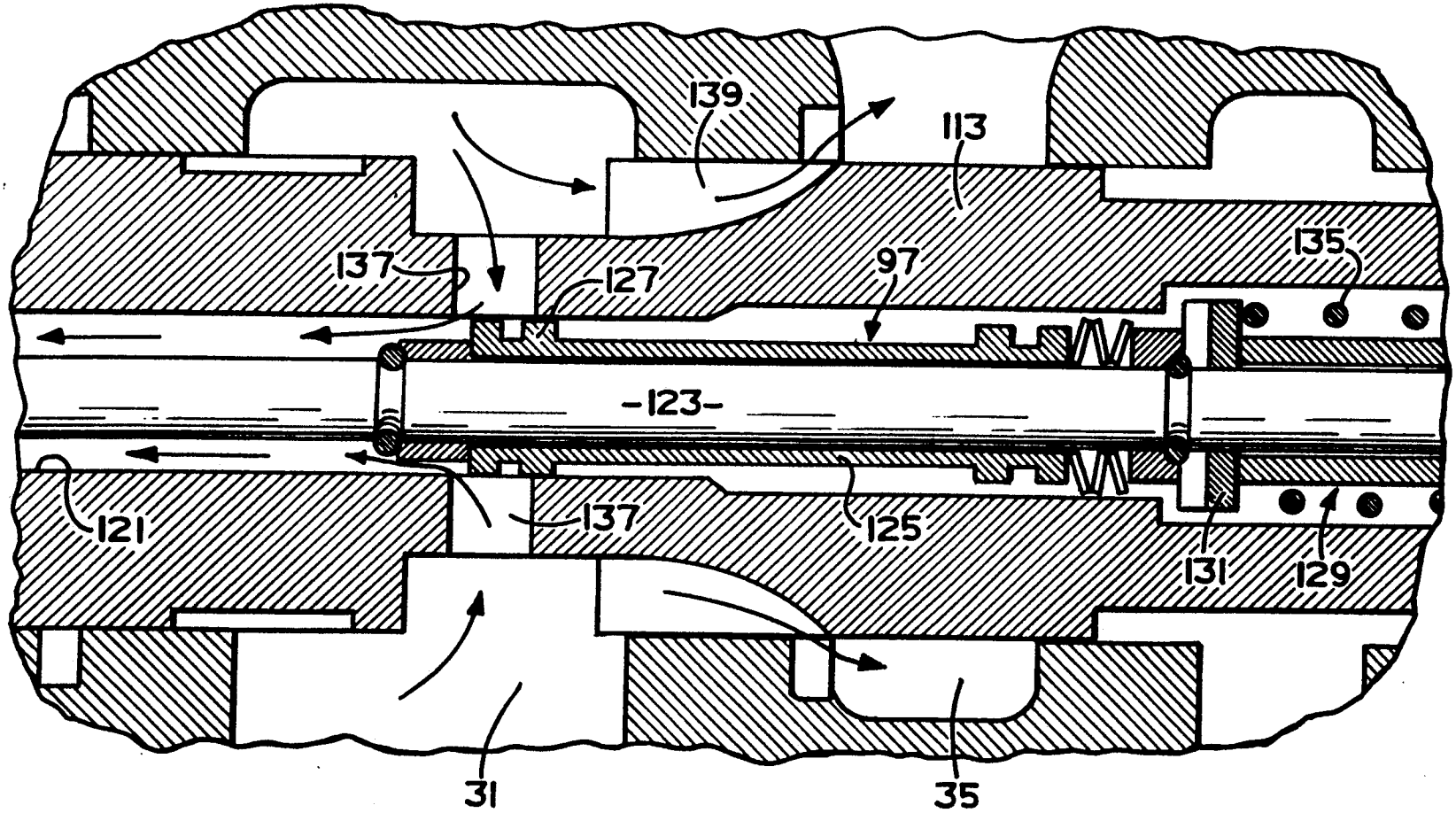
FIG. 3 is a further enlarged, fragmentary axial cross-section, similar to FIG. 2, but with the pilot valve assembly shown in axial cross-section, and in its actuated position.

Referring now primarily to FIGS. 2 and 3, to the right of the sleeve 125 is a centering spring assembly, generally designated 129, disposed about the rod member 123, and including left and right annular spring seats 131 and 133, each of which includes several radial passages or notches to permit fluid flow. Disposed axially between the seats 131 and 133 is a compression spring 135 which biases the pilot valve assembly 97 toward its neutral position shown in FIG. 2, subsequent to any displacement of the pilot valve 97, relative to the main spool 95. The main valve spool 95 defines several radial openings or fluid passages 137 which are in continuous fluid communication with the inlet port 29 through the inlet coring 31. However, with the pilot valve 97 in the neutral position shown in FIG. 2, flow of pressurized fluid through the openings 137 is blocked by the left hand land 127 (which will be referred to subsequently merely as the land 127, in view of the fact that the right hand land is nonfunctional).

As may best be seen in FIG. 3, in the subject embodiment, it is preferred that the cylindrical sleeve 125, which defines the lands 127, be a separate piece, rather than being formed integrally with the rod member 123. One reason for this may be understood by considering the overall length of the rod member 123 (as shown in FIG. 1). If the member 123 and the lands 127 were integral, it would be necessary to maintain nearly perfect concentricity between the pilot bore 121 and the openings defined by the guide members 105 and 107. Lack of such concentricity (i.e., eccentricity) would result in binding, either between the lands 127 and the bore 121, or between the rod member 123 and the guide members 105 and 107.

Operation

Referring now to FIGS. 1, 2, and 3, the basic operation of the flow control valve assembly 11 will be described. When the operator wishes to actuate the valve assembly, such as to lift a load, the rod member 123 is moved to the right (see FIG. 3) a distance representative of the desired flow. With the land 127 no longer blocking the radial openings 137, pressurized fluid in the inlet coring 31 passes through the openings 137, then flows to the left between the pilot bore 121 and the rod member 123, entering and pressurizing the chamber 119. The pilot pressure in the chamber 119 biases the main valve spool 95 to the right, in opposition to the force of the spring 103 until pressurized fluid is able to flow from the inlet coring 31 past the land 113 by means of a pair of metering notches 139, and enters the right leg 35 of the cored portion 37. At the same time, the land 111 opens up an orifice at its left end to permit communication from the left leg 33 into the coring 53. The pressurized fluid in the coring 53 overcomes the bias force of the spring 83, unseating the poppet 81 such that the pressurized fluid flows into the workport coring 49, then out the workport 47 to a load L (see FIG. 4).

Figure 4:
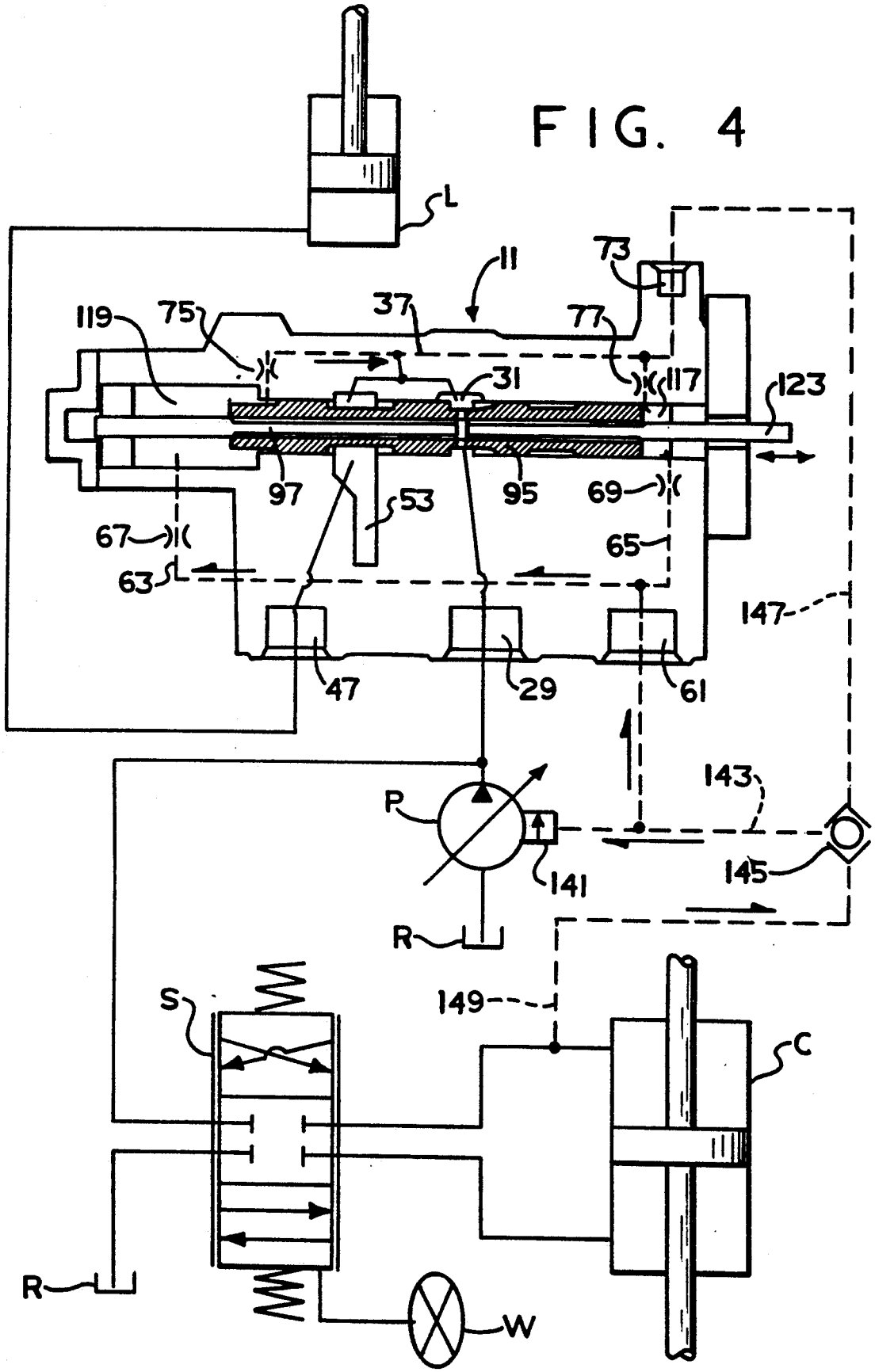
FIG. 4 is a hydraulic schematic of a load-sensing, flow control system, including the flow control valve of the present invention, shown somewhat schematically.

Referring now to FIG. 4, in conjunction with FIGS. 1 through 3, the operation of a system including the valve of the present invention will be illustrated. It should be understood in viewing FIG. 4 that various load signal and pressure signal flow directions are labelled, referring to a condition to be described subsequently, and should therefore be ignored in connection with the initial explanation. The variable displacement pump P includes a pump displacement control 141, of the type well known in the art, and which forms no part of the present invention. The control 141 is responsive to pressure in an adjacent signal line 143, to increase the displacement and flow output of the pump P as the pressure in the signal line 143 increases. The signal line 143 is connected to the outlet of a shuttle valve, shown only schematically, and designated 145. One inlet of the shuttle valve 145 is connected by means of a signal line 147 to the load sense check plug assembly 73, thereby communicating load sense pressure to one inlet of the shuttle valve 145. The other inlet of the shuttle valve 145 is communicated by means of a signal line 149 to the high pressure conduit of a separate load circuit, which is shown schematically in FIG. 4 as a vehicle steering system including a steering valve S controlled by a steering wheel W, with the steering valve S controlling the flow of fluid from the outlet side of the pump P to a steering cylinder C. As is well known to those skilled in the art, the steering system would typically comprise the "priority" load system, i.e., the pressure and flow requirements of the steering system would have to be met first, and only the available, remaining fluid would be directed by the valve assembly 11 to the load L.

Referring still primarily to FIG. 4, the first operating condition of the system to be described, for which the load signal direction arrows in FIG. 4 should be ignored, is the condition in which the pressure being communicated from the work port 47 to the load L is the higher of the two load pressures (or the highest load pressure in the system if there are other valve sections present in the system). In this condition, pressurized fluid flows into the inlet port 29 and the inlet coring 31 at a pressure P1, then flows through the openings 137 into the pilot pressure chamber 119, where the pilot fluid is at a pressure P2 (P2 being somewhat less than P1). Fluid then flows out of the pilot pressure chamber 119 in two parallel flow paths. A first path flows through the orifice 67, through the passage 63, and then to the pump load sense port 61, the fluid ("pump load sense") in this path, downstream of the orifice 67 being at a pressure P3 (P3 being somewhat less than P2). At the same time, fluid flows out of the pilot pressure chamber 119 through the fixed orifice 75, then through the cored portion 37 to the plug assembly 73, the fluid ("work load pressure") in this path, downstream of the orifice 75 being at a pressure P4 (in this condition, P4 is substantially identical to P3).

It should be noted by viewing FIG. 4, in conjunction with FIG. 2, that after the main valve spool 95 is moved to its operating position (as in FIG. 3), the land 115 of the main valve spool 95 blocks communication between the reaction pressure chamber 117 and the rightward portion 41, through the fixed orifice 77. The fixed orifice 77 is disposed as shown, so that the load pressure in the cored portion 37 will not be communicated into the reaction pressure chamber 117 whenever the main valve spool 95 is in an operating position. As a result, there is no flow through the reaction pressure chamber 117, and the pressure in the chamber 117 is substantially the same as the pressure in the pump load sense port 61, i.e., the pressure P3. Thus, one key aspect of the present invention is that the opening of the pilot spool 97 causes a flow through the pilot pressure chamber 119, resulting in a pressure difference (P2–P3) across the main valve spool 95. With the pressure differential (P2–P3) being slightly greater than the force of the centering spring 103, the main valve spool 95 is moved to its operating position as shown in FIG. 3.

If the fluid pressure from the pump P decreases (for example, due to another valve demanding low pressure flow), there would be a decrease in the fluid pressure at the inlet port 29, relative to the pressure in the work port 47. The differential from inlet pressure P1 to load pressure P4 would decrease, resulting in a decrease of flow into and out of the pilot pressure chamber 119. This reduced flow rate would result in a decrease in the pressure in the chamber 119, thus permitting the main valve spool 95 to move slightly to the left in FIG. 3, reducing the orifice area between the inlet 31 and the right leg 35. This reduced flow would result in the pressure differential (P1–P4) being maintained constant. It should be noted that when the main valve spool 95 moves somewhat to the left in FIG. 3, the flow area through the openings 137, past the pilot land 127 increases, thus tending to maintain the pilot flow in spite of the reduced pressured differential. As is well known to those skilled in the art, the operating conditions and changes in flow and pressure differentials of the type described above are not fixed, discrete conditions, but instead, are transient and self-compensating. Thus, in the present invention, the main valve spool 95 and pilot valve assembly 97 cooperate to maintain a constant pressure differential (margin pressure) across the main valve spool. If another valve in the system is demanding flow at a lower pressure, and is not compensated in the same way as the valve 11 of the invention, the other valve (e.g., a steering controller) will be given priority over the valve 11. Because the valve 11 attempts to maintain margin pressure, this insures, by definition, that the valves don't out-run the pump, and that the other valve's priority function is satisfied.

If the pressure at the load L approaches, or becomes greater than the pressure at the outlet of the pump P (a situation which traditionally has been remedied by means of inlet checks), the pressure differential from the pilot pressure chamber 119 to the reaction chamber 117 decreases and the main valve spool 95 moves to the left from the position shown in FIG. 3. This movement of the main valve spool will occur to a sufficient extent to block reverse flow from the workport 47 through the coring 53, then through the right leg 35 into the inlet coring 31. Thus, with the present invention, the main valve spool 95 performs the function of an inlet check.

It should be understood by those skilled in the art that if there are two of the valve assemblies 11 together in a system (to be referred to hereinafter as **11*a* and 11*b* for purposes of subsequent explanation), one valve can easily be given pressure and flow priority over the other. If the valve 11*a* is to be given priority over the valve 11*b*, the centering spring 103 in the valve 11*a* may be replaced by one having a lower force (or conversely, the centering spring 103 in the valve 11*b* can be replaced by one having a greater biasing force). Thus, when the total pressure and flow available in the system becomes insufficient to meet the needs of both valves 11*a* and 11*b*, the higher spring force in the valve 11*b* will cause its main valve spool to begin to close off first, thus giving the valve 11*a*** higher priority.

Referring again primarily to FIG. 4, another operating condition will be described, in which the flow arrows of FIG. 4 now apply. In this condition, it will be assumed that the load at the steering cylinder C is at a higher pressure than the load L. As is shown by the flow arrows in FIG. 4, the higher pressure in the signal line 149 is communicated to the outlet of the shuttle valve 145, and then is communicated by means of the signal line 143 to the displacement control 141 of the pump P. At the same time, the higher pressure in the signal line 149 is communicated from the signal line 143 into the pump load sense port 61. In connection with the description of this operating condition, it will be assumed that the main valve spool 95 and the pilot valve 97 are in the position shown in FIG. 3. The pressure in the port 61 is, in the condition described, substantially higher than the pressure in the work port 47. The main valve spool 95 is maintained in the operating position, such as that shown in FIG. 3, by a pressure differential (difference between the pressure in the pilot chamber 119 and the pressure in the reaction chamber 117), which is just slightly greater than the equivalent force of the centering spring 103. With the main valve spool 95 in the operating condition of FIG. 3, and the fixed orifice 77 blocked, there is no fluid flow through the reaction chamber 117, but merely a pressure head. The pressure at the pump load sense port 61, upstream of the fixed orifice 67 is at a pressure P1, while the pressure downstream of the orifice 67 in the pilot pressure chamber 119 is at a pressure P2, P2 being less than P1. In this condition, there is a flow of fluid from the chamber 119 through the fixed orifice 75 to the cored portion 37, which is at a pressure P3, P3 being less than P2, but still typically higher than the pressure at the work port 47.

In the condition described, the normal pressure differential across the main valve spool is not maintained, because of the higher pressure in the signal line 149 which is transmitted from the pump load sense port 61 through the fixed orifice 69 into the reaction pressure chamber 117. The increased pressure in the chamber 117 reduces the pressure differential between the chambers 119 and 117, thus moving the main valve spool 95 to the left in FIG. 3, and reducing the flow from the inlet 31 to the work port 47. As a result, more of the output of the pump P is available for the priority circuit, i.e., the steering system, thus making it possible to maintain the desired flow through the steering valve S to the steering cylinder C.

Figure 5:
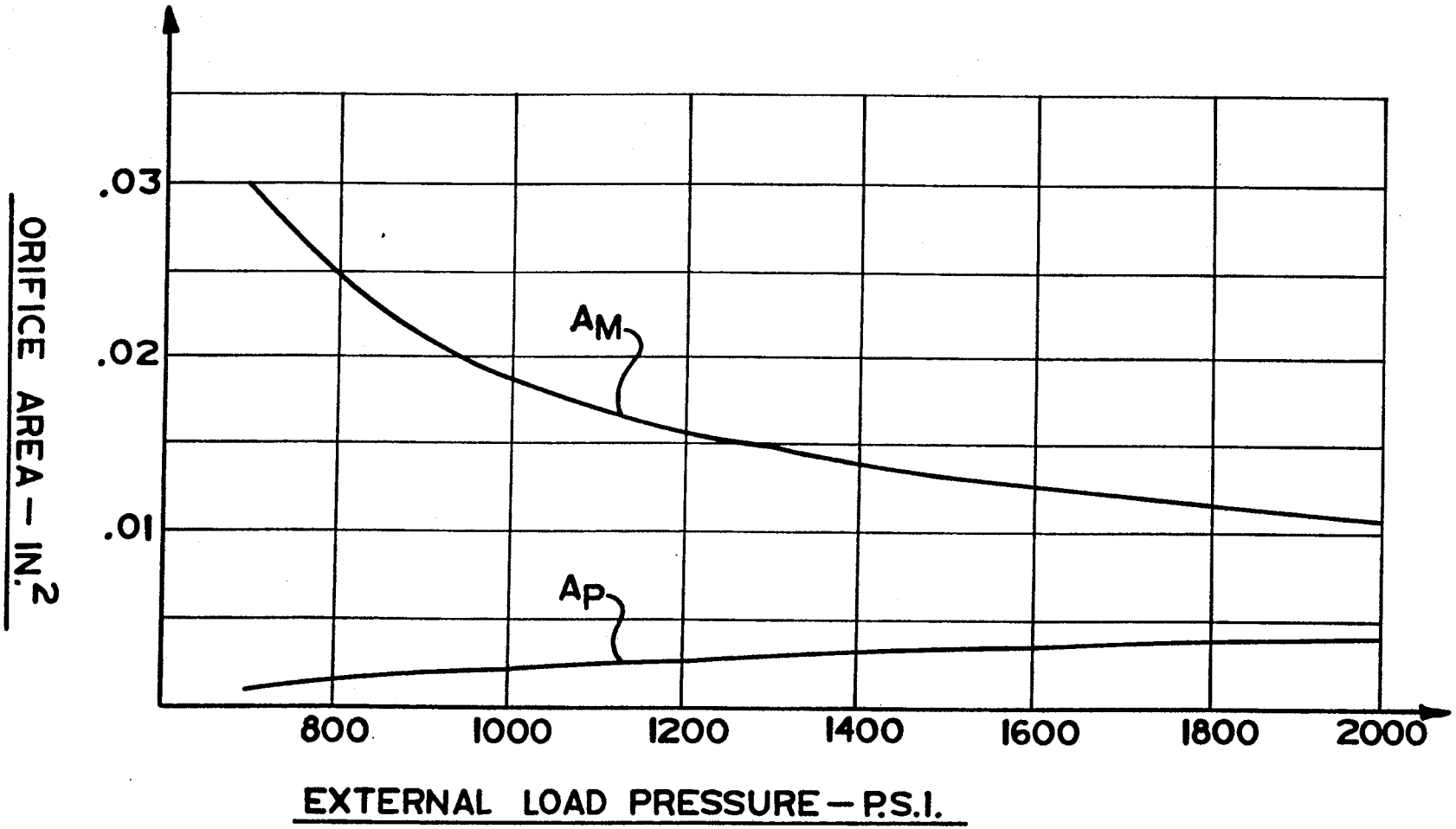
FIG. 5 is a graph of orifice area versus external load pressure, for both the main valve spool and the pilot valve spool.

Referring now primarily to FIG. 5, there is a graph of orifice area versus external load pressure. The graph includes two curves, one curve ($A_M$) representing the orifice area defined by the main valve spool 95, and the other curve ($A_p$) representing the orifice area defined by the overlap of the openings 137 and the pilot land 127. As the external load pressure (i.e., the pressure in the load signal line 149) increases, the pressure differential between the pilot chamber 119 and the reaction chamber 117 decreases. As is shown in FIG. 5, as this occurs, the main valve spool 95 continues to move further to the left, thus reducing the orifice area ($A_M$) defined by the main valve spool 95. Furthermore, as the main valve spool 95 moves to the left, the orifice area ($A_p$) defined by the overlap of the openings 137 and the pilot land 127 increases, although at a much lower rate than the rate at which the orifice $A_M$ decreases, thus maintaining sufficient pilot flow to maintain the position of the main spool 95.

Although the present invention has been illustrated in connection with a three-way, three-position directional and flow control valve, partially for ease of illustration and explanation, those skilled in the art will understand that the invention could also be utilized in various other valve configurations, such as a four-position, four-way directional and flow control valve. Furthermore, although the invention has been illustrated and described in connection with a valve assembly in which the pilot spool is disposed within the main spool, such is not a necessary limitation of the invention. All that is essential to the invention is the provision of a pilot valve means which is operably associated with the main valve spool, and with the pump and work load sense circuits, such that the position of the main valve spool is controlled by a pressure differential resulting from a pilot flow involving the flow from the source to the load, and flow through the load circuits. The pressure in the load circuits can represent either the load being controlled by the valve of the present invention, or the load being controlled by another valve in the system.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A flow control valve assembly for controlling flow of fluid from a source of pressurized fluid to a fluid pressure operated device, said flow control valve assembly comprising a valve housing defining a valve bore, an inlet port for connection to the source of fluid, and a work port for connection to the fluid pressure operated device; a main valve spool disposed within said valve bore and axially movable therein between a neutral position (FIG. 2) blocking fluid communication from said inlet port to said work port, and an operating position (FIG. 3) permitting fluid communication from said inlet port to said work port; said main valve spool defining a pilot bore and fluid passage means communicating between said inlet port and said pilot bore; a pilot spool disposed within said pilot bore, and axially movable therein between a neutral position (FIG. 2) blocking fluid communication through said fluid passage means, and an actuated position (FIG. 3) permitting fluid communication through said fluid passage means; said valve housing and said main valve spool cooperating to define a pilot pressure chamber in fluid communication with said fluid passage means when said pilot spool is in said actuated position, fluid pressure in said pilot pressure chamber being operable to move said main valve spool from said neutral position toward said operating position, characterized by:

(a) the source of pressurized fluid including pressure responsive means for varying the delivery of fluid in response to changes in a load signal pressure;

(b) said valve housing defining a work load signal port for connection to said pressure responsive means, said load signal port being in restricted fluid communication with said pilot pressure chamber, whereby, when said pilot spool is in said actuated position (FIG. 3), a pilot quantity of pressurized fluid flows from said inlet port at a pressure P1, flows through said passage means to said pilot pressure chamber at a pressure P2, P2 being less than P1, then flows to said work load signal port at a pressure P3, P3 being less than P2; and (c) means adapted to receive fluid at a pressure less than said pressure P2, and operable to bias said main valve spool toward said neutral position (FIG. 2), in opposition to the fluid pressure in said pilot pressure chamber.

2. A flow control valve assembly as claimed in claim 1, characterized by said valve housing and said main valve spool cooperating to define a reaction pressure chamber, fluid pressure in said reaction pressure chamber being operable to bias said main valve spool, in opposition to the fluid pressure in said pilot pressure chamber, from said operating position (FIG. 3) toward said neutral position (FIG. 2), said reaction pressure chamber being in fluid communication with said work load signal port, whereby said main valve spool is positioned in response to the differential between said fluid pressures P2 and P3.

3. A flow control valve assembly as claimed in claim 1, characterized by said work port being in restricted fluid communication with said pilot pressure chamber, and with said inlet port, when said main valve spool is in said operating position (FIG. 3), the pressure in said work port being at substantially said pressure P3.

4. A flow control valve assembly as claimed in claim 3, characterized by, when the fluid pressure in said work port is at least equal to the fluid pressure in said inlet port, said pilot flow through said pilot pressure chamber ceases, decreasing the pressure in said pilot pressure chamber to substantially said load pressure P3, whereby said main valve spool moves from said operating position (FIG. 3) to said neutral position (FIG. 2), functioning as an inlet check valve.

5. A flow control valve assembly as claimed in claim 3, characterized by said main valve spool comprising an elongated, multiple-land spool defining said pilot bore, extending the entire axial length of said main valve spool; said pilot spool comprising an elongated rod member, extending axially to at least the axial ends of said main valve spool; said pilot spool further comprising a hollow, cylindrical sleeve defining at least one pilot land operable to block fluid flow through said fluid passage means, when said pilot spool is in said neutral position (FIG. 2).

6. A flow control valve assembly as claimed in claim 5, characterized by guide means disposed at axially opposite ends of said valve bore; said elongated rod member extending axially through, and being supported by said guide means, said elongated rod member and said cylindrical sleeve defining a radial clearance therebetween to accommodate eccentricity between said pilot bore and said guide means.

7. A flow control valve assembly as claimed in claim 1, characterized by, when a decrease in fluid pressure from said source of pressurized fluid causes a decrease in the fluid pressure at said inlet port, relative to the fluid pressure in said work port, said pilot flow through said pilot pressure chamber decreases, decreasing the pressure in said pilot pressure chamber, whereby said main valve spool moves toward said neutral position (FIG. 2), in an attempt to maintain a constant pressure differential across said main valve spool.

8. A flow control valve assembly for controlling flow of fluid from a source of pressurized fluid to a fluid pressure operated device, said flow control valve assembly comprising a valve housing defining a valve bore, an inlet port (29) for connection to the source of fluid, and a work port for connection to the fluid pressure operated device; a main valve spool disposed within said valve bore and axially movable therein between a neutral position (FIG. 2) blocking fluid communication from said inlet port to said work port, and an operating position (FIG. 3) permitting fluid communication from said inlet port to said work port; said axial movement of said main valve spool occurring in response to a pressure differential between a pilot pressure chamber and a reaction pressure chamber, said chambers being disposed at opposite axial ends of said main valve spool; characterized by:

(a) the source of pressurized fluid including pressure responsive means for varying the delivery of fluid in response to changes in a load signal pressure;

(b) said valve housing defining a work load signal port for connection to said pressure responsive means, said work load signal port being in restricted fluid communication with said pilot pressure chamber;

(c) pilot valve means actuatable from a neutral position (FIG. 2) to an actuated position (FIG. 3), operable to control a pilot quantity of pressurized fluid flowing from said inlet port at a pressure P1, then through said pilot pressure chamber at a pressure P2, P2 being less than P1, then flowing to said work load signal port at a pressure P3, P3 being less than P2;

(d) means adapted to receive fluid at a pressure less than said pressure P2, and operable to bias said main valve spool toward said neutral position (FIG. 2), in opposition to the fluid pressure in said pilot pressure chamber.

9. A flow control system for controlling the flow of fluid from a source of pressurized fluid to first and second fluid pressure operated devices, by means of first and second flow control valves, respectively, in parallel fluid communication with said source of pressurized fluid; said source including pressure responsive means for varying the delivery of fluid in response to changes in a load signal pressure, said first and second flow control valves including means operable to provide first and second load signals, respectively, representative of the demand for pressurized fluid by said first and second fluid pressure operated devices, respectively; said second flow control valve comprising a valve housing defining a valve bore, an inlet port connected to said source, a work port connected to said second fluid pressure operated device, a main valve spool disposed within said valve bore and axially movable therein between a neutral position (FIG. 2) blocking fluid communication from said inlet port to said work port, and an operating position (FIG. 3) permitting fluid communication from said inlet port to said work port, said main valve spool defining a pilot bore and fluid passage means communicating between said inlet port and said pilot bore, a pilot spool disposed within said pilot bore and axially movable therein between a neutral position (FIG. 2) blocking fluid communication through said fluid passage means and an actuated position (FIG. 3) permitting fluid communication through said fluid passage means, said valve housing and said main valve spool cooperating to define a pilot pressure chamber and a reaction pressure chamber, fluid pressure in said pilot pressure chamber tending to move said main valve spool toward said operating position and fluid pressure in said reaction pressure chamber tending to move said main valve spool toward said neutral position, said pilot pressure chamber being in fluid communication with said fluid passage means when said pilot spool is in said actuated position (FIG. 3); said flow control system being characterized by:

(a) said valve housing defining a pump load signal port in fluid communication with said pressure responsive means, in restricted fluid communication with said pilot pressure chamber, and in fluid communication with said reaction pressure chamber; and (b) said valve housing defining a work load signal port in fluid communication with said work port, and in restricted fluid communication with said pilot pressure chamber.

10. A flow control system as claimed in claim 9 wherein, when said first load signal is higher than said second load signal, said first load signal is communicated to said pump load signal port and said reaction pressure chamber, and a pilot quantity of pressurized fluid flows from said pump load signal port, at a pressure P1, to said pilot pressure chamber at a pressure P2, P2 being less than P1, then to said work port at a pressure P3, P3 being less than P2, the pressure differential acting on said main valve spool tending to move said valve spool toward said neutral position (FIG. 2).

* * * * *